US007178890B2

(12) United States Patent
Park et al.

(10) Patent No.: US 7,178,890 B2
(45) Date of Patent: Feb. 20, 2007

(54) SHELF HEIGHT ADJUSTER OF REFRIGERATOR

(75) Inventors: Mi-Young Park, Seoul (KR); Angela Ahn, Seoul (KR); Kyeong-Seag Yun, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/941,955

(22) Filed: Sep. 16, 2004

(65) Prior Publication Data

US 2005/0062380 A1 Mar. 24, 2005

(30) Foreign Application Priority Data

Sep. 18, 2003 (KR) ..... 10-2003-0064940

(51) Int. Cl.
*A47B 96/02* (2006.01)

(52) U.S. Cl. ..... 312/408

(58) Field of Classification Search ..... 312/401, 312/408, 410, 294, 306, 312; 62/381, 382, 62/440

See application file for complete search history.

(56) References Cited

U.S. PATENT DOCUMENTS 1,997,793 A * 4/1935 Hull et al. ..... 312/408
2,829,022 A * 4/1958 Lewis ..... 312/408
3,337,283 A * 8/1967 Schlenkert ..... 312/306
3,610,174 A * 10/1971 Kesling ..... 108/56.1
3,885,846 A * 5/1975 Chuang et al. ..... 312/306
3,982,801 A * 9/1976 Heidorn et al. ..... 312/306
5,199,778 A * 4/1993 Aoki et al. ..... 312/408
6,065,821 A * 5/2000 Anderson et al. ..... 312/408
6,363,738 B2 * 4/2002 Nakajima et al. ..... 62/440

* cited by examiner

*Primary Examiner*—James O. Hansen
(74) *Attorney, Agent, or Firm*—Birch, Stewart, Kolasch & Birch, LLP

(57) ABSTRACT

The present invention relates to a shelf height adjuster of a refrigerator. According to the present invention, gear portions 12 are vertically formed on both side surfaces on a refrigerating chamber of the refrigerator. Height adjustment gears 22 which are engaged with the gear portions 12 are rotatably installed in opposite sides of a shelf 20, respectively. Each stopper 30 for regulating the rotation of each height adjustment gear is engaged to the height adjustment gear 22 by means of a spring 32, and thus, it causes the height adjustment gear 22 not to rotate. When the height of shelf is adjusted, the height adjustment gears 22 are made freely rotate by releasing the stoppers 30 from the height adjustment gears 22, and thus, the height of the shelf may be adjusted without taking out the shelf from the refrigerator.

12 Claims, 3 Drawing Sheets

SHELF HEIGHT ADJUSTER OF REFRIGERATOR

This Non-provisional application claims priority under 35 U.S.C. § 119(a) on Patent Application No(s). 10-2003-0064940 filed in Korea, Republic of on Sep. 18, 2003, the entire contents of which are hereby incorporated by reference.

BACKGROUND OF THE INVENTION

1. Field of Invention

The present invention relates to a refrigerator, and more particularly, to a shelf height adjuster capable of effectively using a storage space in a refrigerator by adjusting a height of a shelf installed in a refrigerating chamber.

2. Description of the Prior Art

As shown in FIG. 1 which is a perspective view of a general refrigerator, the interior of the refrigerator is divided into a refrigerating chamber 2 and a freezing chamber 4. The refrigerating and freezing chambers 2 and 4 may be opened or closed by doors 6 and 8, respectively.

A plurality of shelves 5 for effectively accommodating foods are installed in a multistage fashion in the refrigerating chamber 2. The shelves 5 are spaced apart from each other at certain intervals and supported on both side surfaces in the refrigerating chamber 2. Spacing between the shelves 5 is predetermined at certain intervals when the refrigerator is designed, or may be adjusted appropriately according to user's convenience. For example, each of the shelves 5 is supported by upper portions of supporting projections formed on both the side surfaces in the refrigerating chamber. The shelf supporting projections are formed at regular intervals and cause a height of the shelf to be adjusted according to user's choice.

Since foods or containers stored in the refrigerator generally have certain heights, the spacings between the shelves 5 are determined in consideration of the general heights of the foods or containers. That is, since the general foods or containers are not substantially accommodated on the shelves if the spacing between the shelves 5 is too small, three or four of the shelves are generally installed in the refrigerating chamber 2 at appropriate intervals.

However, the height of the shelf 5 should be adjusted according to use conditions or the kind of foods to be stored. For example, since the spacing between the shelves 5 for storing tall foods should be large, the height adjustment of the shelf should be substantially performed according to the use conditions.

In order to adjust the height of the shelf 5 at present, however, the shelf 5 should be removed from the refrigerator and then be inserted into the refrigerator in a state where its height is appropriately determined again. In the conventional structure, therefore, to adjust the height of the shelf, the position of the shelf should be adjusted after all the stored foods are taken out. That is, according to the prior art, it is noted that the disadvantage in use, that is, the difficulty in adjusting the position of the shelf is presented. Furthermore, in the conventional shelf, since the heights at which the shelf may be adjusted are predetermined by means of positions of the supporting projections for supporting the shelf, it is substantially impossible to minutely adjust the height of shelf to the extent of user's desire.

SUMMARY OF THE INVENTION

An object of the present invention is to provide a shelf height adjuster of a refrigerator capable of more easily adjusting vertical position of a shelf installed at a certain interval in the refrigerator.

Such an object of the present invention means that the shelf is configured to adjust the height of the shelf without removing the shelf from the refrigerator. That is, it means that the height of the shelf may be adjusted without taking out stored foods on the shelf.

According to an aspect of the present invention for achieving the object, there is provided a shelf height adjuster of a refrigerator. The shelf height adjuster comprises gear portions vertically formed on both side surfaces on a refrigerating chamber of the refrigerator; a shelf including height adjustment gears provided at opposites sides thereof and engaged with the gear portions, respectively; and a stopping unit for regulating rotations of the height adjustment gears.

According to an embodiment of the present invention, the stopping unit may comprise a stopper engaged to a portion of the height adjustment gear; and a spring for elastically supporting the stopper toward the height adjustment gear. Further, the rotation of the height adjustment gear is controlled by operating the stopper.

According to the present invention, as the height adjustment gears, the rotations of which are regulated by the stopping units, are vertically move along the gear portions, respectively, the height of the shelf may be substantially adjusted in the refrigerator. Therefore, without removing the shelf from the refrigerator, it is possible to exactly adjust the height of the shelf to the extent of user's desire.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF THE PREFERRED EMBODIMENT

Hereinafter, the present invention will be described in detail on the basis of preferred embodiments illustrated in the accompanying drawings.

Figure 1:
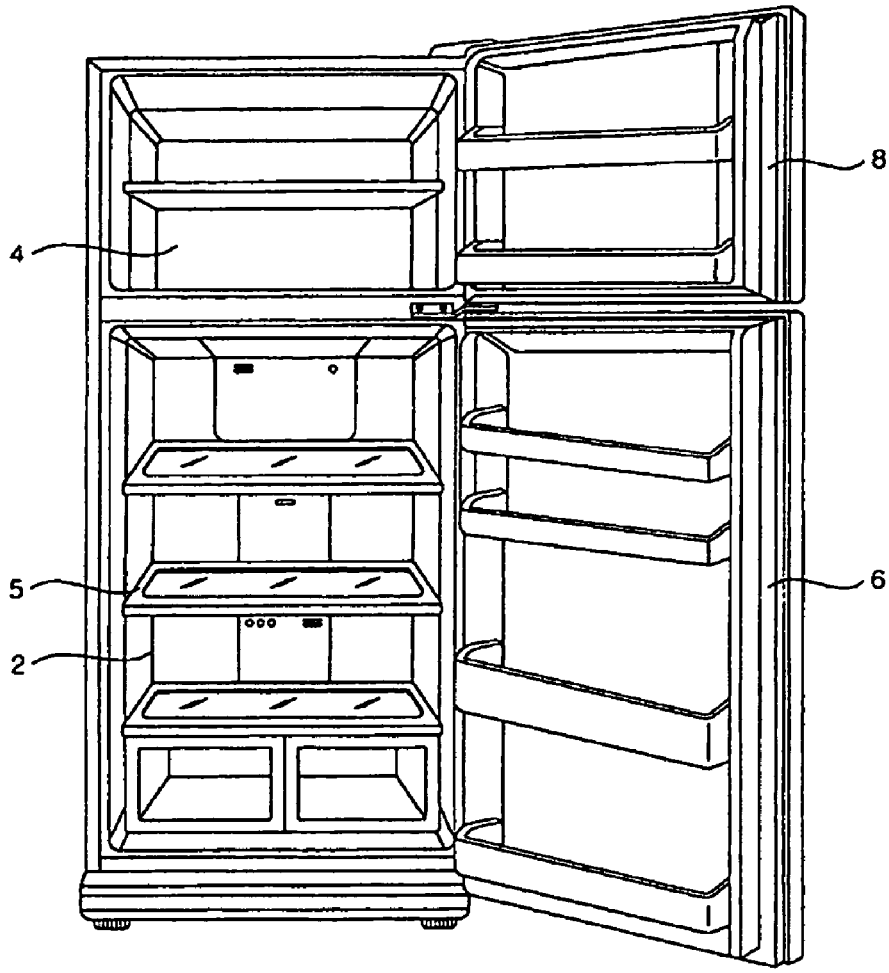
FIG. 1 Prior Art
FIG. 1 is a perspective view of a general refrigerator with doors opened.
Figure 2:
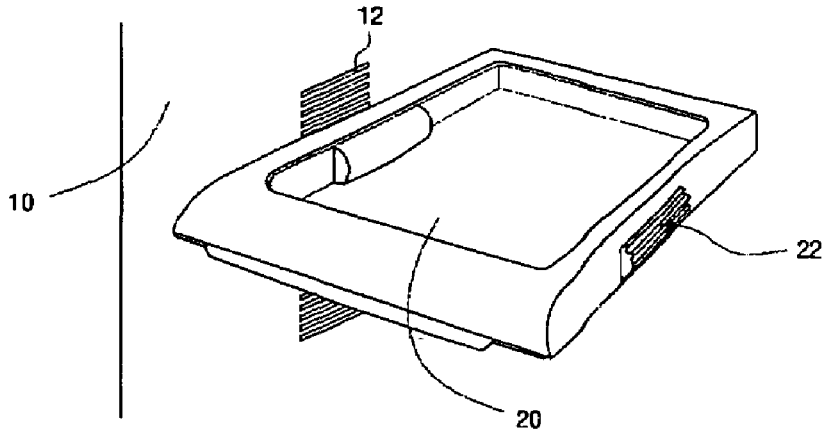
FIG. 2 is a perspective view of a major portion of a refrigerator according to the present invention.

As shown in FIG. 2 which is a perspective view of a major portion of the present invention, gear portions 12 are vertically formed on both side surfaces of the refrigerating chamber 10 of a refrigerator according to the present invention, respectively. According to the present invention, height adjustment gears 22 engaged with the gear portions 12 are rotatably installed in opposite sides of a shelf 20 on which foods are put for storage, respectively.

It is noted that according to the present invention, the shelf 20 is supported in the refrigerating chamber, as the respective height adjustment gears 22 installed in the opposite sides of a shelf 20 are engaged with the gear portions 12 formed on both the side surfaces of the refrigerating chamber 10.

Figure 3:
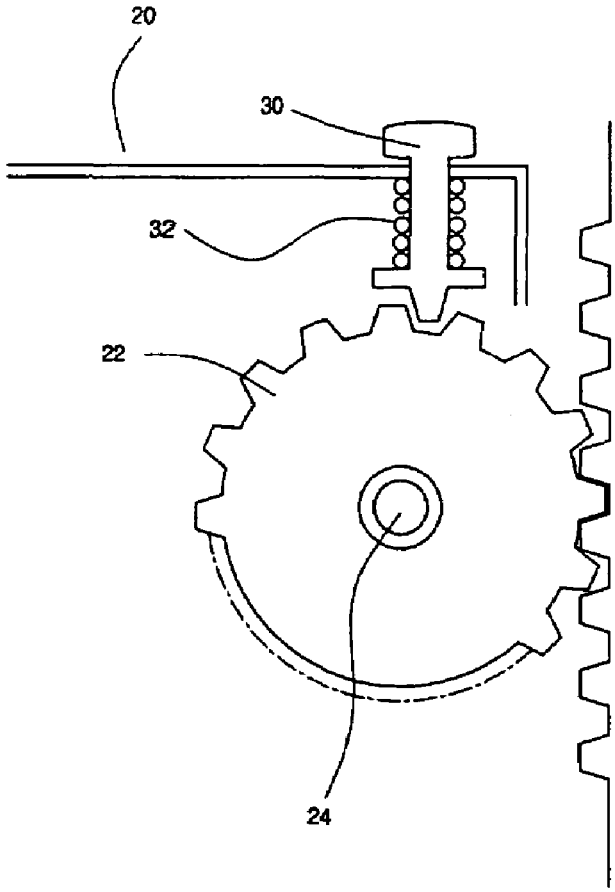
FIG. 3 is a sectional view of a first embodiment of a stopping unit of the present invention.

In addition, as shown in FIG. 3, a pair of the height adjustment gears 22 engaged with the gear portions 12 are rotatably installed in both the sides of the shelf 20, respectively. The height adjustment gears 22 are supported rotatably about rotation axes 24 in the shelf 20 and engaged with the gear portions 12 formed on both the side surfaces of the refrigerating chamber (storage space) of the refrigerator, respectively. Therefore, if the height adjustment gears 22 rotate, the shelf 20 moves vertically. That is, due to the rotations of the height adjustment gears 22, the shelf 20 can be vertically moved without removing the shelf 20 from the refrigerator.

Furthermore, in order to maintain the determined position of the shelf 20, a stopping unit for supporting the height adjustment gear 22 in order not to rotate should be installed. In an embodiment shown in FIG. 3, a stopper 30 is installed at a top portion of each of the opposite sides of the shelf 20 in order to prevent the height adjustment gear 22 from rotating. In the state that the position of the shelf 20 is fixed, a lower end of each of the stoppers 30 is inserted between teeth of the height adjustment gear 22. Therefore, since the height adjustment gears 22 cannot further rotate as shown in FIG. 3 when the lower ends of the stoppers 30 are engaged to the height adjustment gears 22, respectively, the foods can be substantially positioned on and supported by the shelf 20.

In such a state, each of the stoppers 30 is elastically supported downward by a spring 32. That is, since the spring 32, which is interposed between the top portion (i.e., a top face) of the shelf 20 and the stopper 30, always elastically supports the stopper 30 downward, the stopper 30 is maintained to a state where the height adjustment gear 22 can be substantially fixed.

In order to adjust the height of the shelf 22 in such a state, the stoppers 30 which are assembled to protrude from the upper portion of the shelf 20 should be pulled up. If the stoppers 30 are pulled up, the springs 32 are compressed, and the respective lower ends of the stoppers 30 are spaced apart from the height adjustment gears 22. Accordingly, the height adjustment gears 22 become in a freely rotatable state, and thus, it is possible to substantially adjust the shelf 20 either upward or downward.

Next, a stopping unit according to another embodiment shown in FIG. 4 will be described in detail. As shown in the figure, a lower end 42 of a stopper 40 of the present embodiment extends downward to be caught between the teeth of the height adjustment gear 22. An upper end 44 of the stopper 40 is formed so as to protrude upward from the shelf 20.

In the present embodiment, the lower and upper ends 42 and 44 of the stopper 40 are spaced apart from each other. An intermediate portion between the two ends is pivotably installed in the shelf 20 by a pin P. In addition, a spring S for compressing the lower end 42 of the stopper 40 downward is interposed between the stopper 40 and a portion of the shelf 20.

Figure 4:
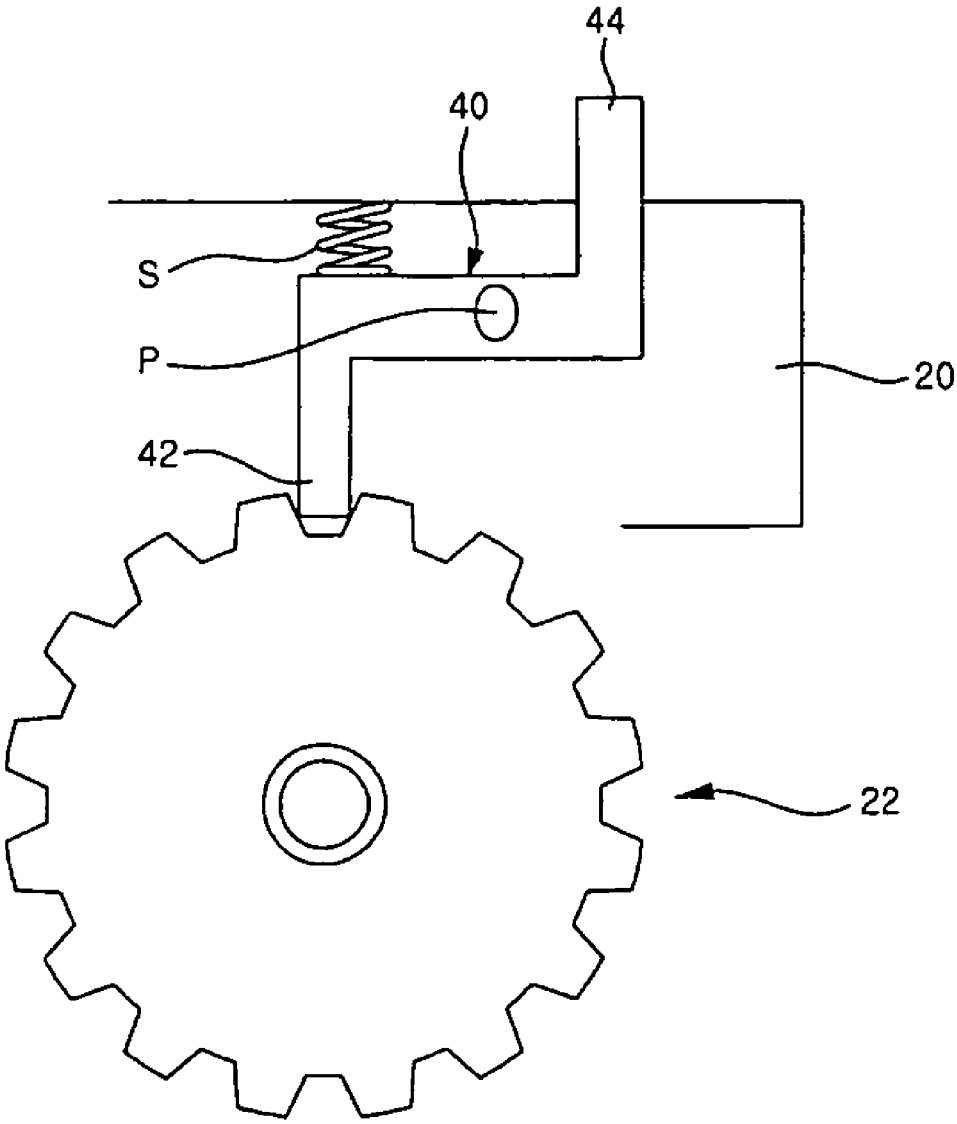
FIG. 4 is a sectional view of a second embodiment of the stopping unit of the present invention.

In the embodiment shown in FIG. 4, the lower end 42 of the stopper 40 is engaged to a portion of the height adjustment gear 22 by means of the spring S. In such a state, the height adjustment gear 22 is fixed so that it cannot rotate, as describe above. Therefore, the height of the shelf 20 is maintained at its determined level. Then, in order to adjust the height of the shelf 20, if the upper ends 44 of the stoppers 40, which are installed in both the sides of the shelf 20, are compressed downward, the lower ends 42 of the stoppers 40 move upward about the pins P, respectively. Therefore, the lower ends 42 of the stoppers 40 are released from the height adjustment gears 22, so that the height adjustment gears 22 may rotate. In such a state, if the shelf 20 moves either upward or downward, the height adjustment gears 22 engaged with the gear portions 12 also rotate together therewith, respectively. Thus, it is possible to adjust the height of the shelf 20.

It is noted that the stoppers 30 and 40 of the above embodiments function to fix or release the height adjustment gears 22 which are rotatably installed in the opposite sides of the shelf 20.

According to the present invention so constructed, the following advantages can be expected.

The height of the shelf according to the present invention may be adjusted even without taking out the shelf from the refrigerating chamber. Therefore, the inconvenience in use caused from the removal and reinstallation of the shelf can be removed. At the same time, the convenience in use that the height of the shelf may be adjusted with the foods being on the shelf can be expected.

Furthermore, according to the present invention, it is possible to minutely adjust the height of the shelf. That is, since the shelf can be set at user's desired position by adjusting the rotation of the height adjustment gears engaged with the respective gear portions, the advantage that the interior space of the refrigerating chamber may be adjusted appropriately according to user's purpose can be also expected.

It is naturally possible to make various modifications of the configuration for allowing the height adjustment gear 22 to rotate or for fixing the height adjustment gear 22 in order not to rotate. That is, as the stopper for regulating the rotation of the height adjustment gear 22, a stopper having another configuration instead of the present embodiments can also be applied.

In the illustrated embodiments, although each of the gear portions 12 is formed on each of the side surfaces of the refrigerating chamber and there are provided the pair of the height adjustment gears 22, the present invention is not limited to the embodiments. For example, a pair of the gear portions 12 may be formed on each of the side surfaces of the refrigerating chamber, and two pairs of the height adjustment gears 22 corresponding thereto may be installed in the shelf.

According to the present invention, it is noted that there is the fundamental technical spirit in that the height adjustment gears 22 engaged with the gear portions 12 are rotatably installed in the opposite sides of the shelf 20 so that the shelf 20 may vertically move in the refrigerating chamber. It will be apparent that those skilled in the art can make various modifications and changes thereto within the fundamental technical spirit of the present invention. Therefore, it is obvious that the true scope of the present invention should be defined by the technical spirit of the appended claims.

What is claimed is:

1. A shelf height adjuster of a refrigerator, comprising:

gear portions vertically formed on a first lateral inner surface and a second lateral inner surface of a refrigerating chamber of the refrigerator, the first lateral inner surface facing toward the second lateral inner surface;

a shelf including height adjustment gears located at two lateral sides of the shelf and engaged with the gear portions, respectively; and a stopper unit for regulating rotations of the height adjustment gears, the stopper unit comprises a stopper including an upper end protruding from an upper surface of the shelf and a lower end engaged to the height adjustment gear, and a spring for elastically urging the stopper toward the height adjustment gear, wherein an axial direction of the height adjustment gears is parallel to the two lateral inner surfaces.

2. The shelf height adjuster as claimed in claim 1, wherein the stopper unit comprises a stopper engaged to a portion of the height adjustment gear, and a spring for elastically supporting the stopper toward the height adjustment gear.

3. The shelf height adjuster as claimed in claim 2, wherein the spring is elastically against an inner upper surface of the shelf.

4. The shelf height adjuster as claimed in claim 3, wherein the spring is in contact with the inner upper surface of the shelf.

5. The shelf height adjuster as claimed in claim 1, wherein a portion of the height adjustment gears is exposed at the two lateral sides of the shelf.

6. The shelf height adjuster as claimed in claim 1, wherein the gear portions have a plurality of teeth formed by the first lateral inner surface and the second lateral inner surface of the refrigerating chamber.

7. The shelf height adjuster as claimed in claim 6, wherein the teeth formed by the first lateral inner surface of the refrigerating chamber face toward the teeth formed by the second lateral inner surface of the refrigerating chamber.

8. A shelf height adjuster of a refrigerator, comprising:

gear portions vertically formed on both side surfaces on a refrigerating chamber of the refrigerator;

a shelf including height adjustment gears provided at opposite sides thereof and engaged with the gear portions, respectively; and a stopper unit for regulating rotations of the height adjustment gears, the stopper unit being inserted into a gap between adjacent teeth of at least one of the height adjustment gears to stop the rotations of the height adjustment gears, wherein the stopper unit comprises a stopper inserted into the gap between adjacent teeth of the at least one of the height adjustment gears, and a spring for elastically supporting the stopper toward the at least one of the height adjustment gears.

9. The shelf height adjuster as claimed in claim 8, wherein the stopper unit passes through an upper surface of the shelf.

10. The shelf height adjuster as claimed in claim 8, wherein the spring is elastically against an inner upper surface of the shelf.

11. The shelf height adjuster as claimed in claim 10, wherein the spring is in contact with the inner upper surface of the shelf.

12. A shelf height adjuster of a refrigerator, comprising:

gear portions vertically formed on both side surfaces on a refrigerating chamber of the refrigerator;

a shelf including height adjustment gears provided at opposite sides thereof and engaged with the gear portions, respectively; and a stopper unit for regulating rotations of the height adjustment gears, the stopper unit being inserted into a gap between adjacent teeth of at least one of the height adjustment gears to stop the rotations of the height adjustment gears, wherein the stopper unit comprises a stopper including an upper end protruding from an upper surface of the shelf and a lower end inserted into the gap between adjacent teeth of the at least one of the height adjustment gears, and a spring for elastically urging the stopper toward the at least one of the height adjustment gears.

* * * * *